US012611079B2

(12) United States Patent
Her et al.

(10) Patent No.: US 12,611,079 B2
(45) Date of Patent: Apr. 28, 2026

(54) VACUUM CLEANER

(71) Applicant: LG Electronics Inc., Seoul (KR)

(72) Inventors: Jonguk Her, Seoul (KR); Kietak Hyun, Seoul (KR); Soohan Eo, Seoul (KR); Inkyu Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 295 days.

(21) Appl. No.: 18/260,417

(22) PCT Filed: Aug. 27, 2021

(86) PCT No.: PCT/KR2021/011491
§ 371 (c)(1),
(2) Date: Jul. 5, 2023

(87) PCT Pub. No.: WO2022/149682
PCT Pub. Date: Jul. 14, 2022

(65) Prior Publication Data

US 2024/0057832 A1 Feb. 22, 2024

(30) Foreign Application Priority Data

Jan. 5, 2021 (KR) ..... 10-2021-0001078

(51) Int. Cl.
*A47L 9/16* (2006.01)
*A47L 5/28* (2006.01)
(Continued)

(52) U.S. Cl.
CPC ..... *A47L 9/1608* (2013.01); *A47L 5/28* (2013.01); *A47L 9/1616* (2013.01);
(Continued)

(58) Field of Classification Search
CPC ..... A47L 9/1683; A47L 9/1608; A47L 5/28; A47L 5/24
See application file for complete search history.

(56) References Cited

U.S. PATENT DOCUMENTS

2010/0251508 A1 10/2010 Ni
2011/0308038 A1 12/2011 Rowntree
(Continued)

FOREIGN PATENT DOCUMENTS

KR 10-2007-0041233 4/2007
KR 10-2007-0106526 11/2007
KR 10-2009-0063342 6/2009

OTHER PUBLICATIONS

International Search Report and Written Opinion in International Appln. No. PCT/KR2021/011491, mailed on Dec. 2, 2021, 8 pages(with English translation).
(Continued)

*Primary Examiner* — Michael D Jennings
(74) *Attorney, Agent, or Firm* — Fish & Richardson P.C.

(57) ABSTRACT

The present invention relates to a cleaner including a dust bin having an inlet port formed at one side thereof, a discharge port formed at the other side thereof, and a cyclone part provided therein and configured to generate a cyclone flow, and a suction part configured to communicate with the inlet port and elongated in one direction, in which the cyclone part includes an axis of a cyclone flow, which is perpendicular to a longitudinal axis of the suction part and parallel to the ground surface, such that the cleaner may clean a lower region such as a gap below a sofa or furniture without affecting a height of a main body of the cleaner even though a length of the dust bin increases.

19 Claims, 12 Drawing Sheets

(51) Int. Cl.
*A47L 9/32* (2006.01)
*A47L 5/24* (2006.01)

(52) U.S. Cl.
CPC ..... *A47L 9/1666* (2013.01); *A47L 9/1683* (2013.01); *A47L 9/325* (2013.01); *A47L 5/24* (2013.01)

(56) References Cited

U.S. PATENT DOCUMENTS

| | | | | |
|---|---|---|---|---|
| 2013/0091655 | A1* | 4/2013 | Smith | A47L 9/1625 15/344 |
| 2016/0088988 | A1 | 3/2016 | Eo et al. | |
| 2016/0174803 | A1* | 6/2016 | Vines | B01D 46/446 55/482 |
| 2016/0206169 | A1* | 7/2016 | Hyun | B04C 5/28 |
| 2018/0177367 | A1 | 6/2018 | Amaral et al. | |

OTHER PUBLICATIONS

Office Action in Korean Appln. No. 10-2021-0001078, mailed on Jan. 2, 2026, 6 pages (only Official Copy).

* cited by examiner

VACUUM CLEANER

CROSS-REFERENCE TO RELATED APPLICATIONS

This application is a National Stage application under 35 U.S.C. § 371 of International Application No. PCT/KR2021/011491, filed on Aug. 27, 2021, which claims the benefit of Korean Application No. 10-2021-0001078, filed on Jan. 5, 2021. The disclosures of the prior applications are incorporated by reference in their entirety.

TECHNICAL FIELD

The present invention relates to a cleaner, and more particularly, to a vacuum cleaner in which a longitudinal axis of a suction part and an axis of a cyclone flow are disposed to be perpendicular to each other.

BACKGROUND ART

In general, a cleaner refers to an electrical appliance that draws in small garbage or dust by sucking air using electricity and fills a dust bin provided in a product with the garbage or dust. Such a cleaner is generally called a vacuum cleaner.

The cleaners may be classified into a manual cleaner which is moved directly by a user to perform a cleaning operation, and an automatic cleaner which performs a cleaning operation while autonomously traveling. Depending on the shape of the cleaner, the manual cleaners may be classified into a canister cleaner, an upright cleaner, a handy cleaner, a stick cleaner, and the like.

The canister cleaners were widely used in the past as household cleaners. However, recently, there is an increasing tendency to use the handy cleaner and the stick cleaner in which a dust bin and a cleaner main body are integrally provided to improve convenience of use.

In the case of the canister cleaner, a main body and a suction port are connected by a rubber hose or pipe, and in some instances, the canister cleaner may be used in a state in which a brush is fitted into the suction port.

The handy cleaner (hand vacuum cleaner) has maximized portability and is light in weight. However, because the handy cleaner has a short length, there may be a limitation to a cleaning region. Therefore, the handy cleaner is used to clean a local place such as a desk, a sofa, or an interior of a vehicle.

A user may use the stick cleaner while standing and thus may perform a cleaning operation without bending his/her waist. Therefore, the stick cleaner is advantageous for the user to clean a wide region while moving in the region. The handy cleaner may be used to clean a narrow space, whereas the stick cleaner may be used to clean a wide space and also used to a high place that the user's hand cannot reach. Recently, modularized stick cleaners are provided, such that types of cleaners are actively changed and used to clean various places.

There is a vacuum cleaner having a cyclone separation device in the related art related to the handy cleaner or the stick cleaner. In the cleaner in the related art, a cylindrical dust bin having a vertical axis is provided, and a plurality of cyclone parts each having a vertical axis is disposed in the dust bin. The air introduced into the dust bin is separated from dust by the cyclone part, and the separated dust is collected at a lower portion of the dust bin.

To increase an internal space of the dust bin in the related art, a diameter needs to be increased in a radial direction with respect to the vertical axis, or a length needs to be increased in a direction of the vertical axis. One of the two methods, which increases the length of the dust bin, is commonly used to smoothly generate a cyclone flow. However, the increase in length of the dust bin causes a problem in which it is impossible to clean a lower gap of a sofa by lowering an angle of the cleaner.

DISCLOSURE

Technical Problem

An object to be achieved by the present invention is to provide a cleaner that may easily clean a narrow gap by lowering a use angle of the cleaner even though an internal space of a dust bin is increased by changing a length of the dust bin in an axial direction instead of a radial direction of the dust bin.

Another object of the present invention is to provide a cleaner that distinguishes sucked pieces of dust for each size, separately collects the pieces of dust, and discards the collected pieces of dust for each size in order to prevent fine dust from scattering.

Technical problems of the present invention are not limited to the aforementioned technical problems, and other technical problems, which are not mentioned above, may be clearly understood by those skilled in the art from the following descriptions.

Technical Solution

To achieve the above-mentioned objects, a cleaner according to an embodiment of the present invention includes: a dust bin including an inlet port formed at one side thereof, a discharge port formed at the other side thereof, and a cyclone part provided therein and configured to generate a cyclone flow; and a motor part configured to communicate with the dust bin and generate a flow of air in the dust bin, in which the dust bin includes: a casing having the inlet port and the discharge port; a separation wall configured to divide an internal space of the casing; a first dust storage part configured to communicate with the inlet port in the internal space; a second dust storage part configured to communicate with the discharge port in the internal space; and a communication hole formed in the separation wall and configured to allow the first dust storage part and the second dust storage part to communicate with each other.

The cleaner may further include: a suction part configured to communicate with the inlet port and elongated in one direction, in which the cyclone part includes an axis of a cyclone flow that is perpendicular to a longitudinal axis of the suction part and parallel to the ground surface.

The inlet port may be disposed at a lateral side of the suction part.

The cleaner of may further include: a suction part configured to communicate with the inlet port, in which the cyclone part is disposed below the suction part.

The separation wall may divide the internal space of the casing based on a straight line A1 passing through the inlet port and the discharge port so that the first dust storage part is disposed at one side and the second dust storage part is disposed at the other side.

The separation wall may be disposed in parallel with a direction in which air is introduced into the inlet port.

The cyclone part may include a first cyclone disposed in the first dust storage part and having a cylindrical shape.

The cyclone part may further include a cyclone filter disposed in the communication hole.

The cyclone part may further include a second cyclone disposed in the second dust storage part.

The cyclone part may further include a compression plate disposed in an opening portion of the first dust storage part.

To achieve the above-mentioned objects, a cleaner according to another embodiment of the present invention includes: a suction part elongated in one direction; a dust bin including an inlet port configured to communicate with the suction part and formed at one side thereof, a discharge port formed at the other side thereof, and a cyclone part configured to generate a cyclone flow; and a motor part configured to communicate with the discharge port of the dust bin and generate a flow of air in the dust bin, in which a longitudinal axis of the suction part intersects an axis of a cyclone flow in the cyclone part.

Other detailed matters of the exemplary embodiment are included in the detailed description and the drawings.

Advantageous Effects

The cleaner of the present invention may have one or more of the following effects.

First, the axis of the cyclone flow intersects the longitudinal axis of the suction part and disposed in parallel with the ground surface. Therefore, even the increase in length of the dust bin does not affect the height of the cleaner, such that the use angle of the cleaner may be sufficiently decreased, which makes it possible to clean a lower region such as a gap below a sofa.

Second, based on the separation wall, larger dust is collected in the first dust storage part, and smaller dust is collected in the second dust storage part, such that the pieces of dust may be collected while being distinguished depending on sizes of the pieces of dust, thereby preventing the fine dust from scattering.

Third, the compression plate is provided to compress the dust collected in the first dust storage part, which may provide an effect of collecting a larger amount of dust in a limited space.

The effects of the present invention are not limited to the aforementioned effects, and other effects, which are not mentioned above, will be clearly understood by those skilled in the art from the claims.

MODE FOR INVENTION

Figure 1:
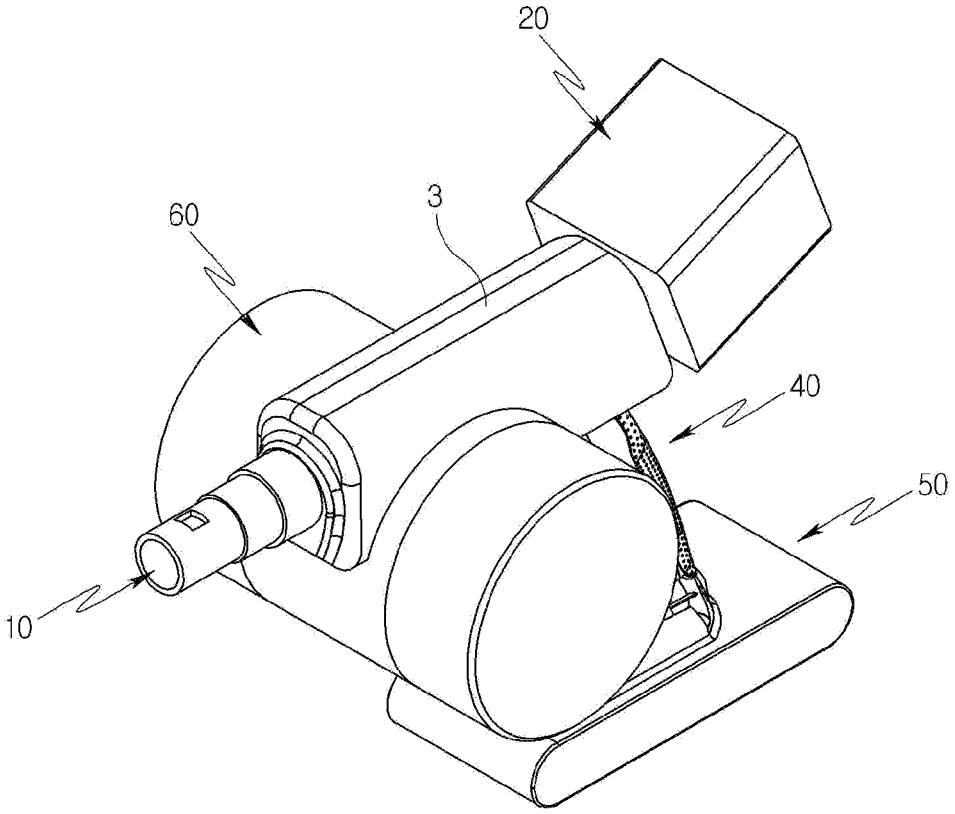
FIG. 1 is a perspective view of a cleaner according to an embodiment of the present invention.

Hereinafter, exemplary embodiments of the present invention will be described in detail with reference to the accompanying drawings.

The present invention may be variously modified and may have various embodiments, and particular embodiments illustrated in the drawings will be specifically described below. The description of the embodiments is not intended to limit the present invention to the particular embodiments, but it should be interpreted that the present invention is to cover all modifications, equivalents and alternatives falling within the spirit and technical scope of the present invention.

In the description of the present invention, the terms such as "first" and "second" may be used to describe various constituent elements, but the constituent elements may not be limited by the terms. These terms are used only to distinguish one constituent element from another constituent element. For example, a first component may be named a second component, and similarly, the second component may also be named the first component, without departing from the scope of the present invention.

The term "and/or" may include any and all combinations of a plurality of the related and listed items.

When one constituent element is described as being "coupled" or "connected" to another constituent element, it should be understood that one constituent element can be coupled or connected directly to another constituent element, and an intervening constituent element can also be present between the constituent elements. When one constituent element is described as being "coupled directly to" or "connected directly to" another constituent element, it should be understood that no intervening constituent element is present between the constituent elements.

The terminology used herein is used for the purpose of describing particular embodiments only and is not intended to limit the present invention. Singular expressions may include plural expressions unless clearly described as different meanings in the context.

The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or groups thereof.

Unless otherwise defined, all terms used herein, including technical or scientific terms, may have the same meaning as commonly understood by those skilled in the art to which the present invention pertains. The terms such as those defined in a commonly used dictionary may be interpreted as having meanings consistent with meanings in the context of related technologies and may not be interpreted as ideal or excessively formal meanings unless explicitly defined in the present application.

Further, the following embodiments are provided to more completely explain the present invention to those skilled in the art, and shapes and sizes of elements illustrated in the drawings may be exaggerated for a more apparent description.

Figure 2:
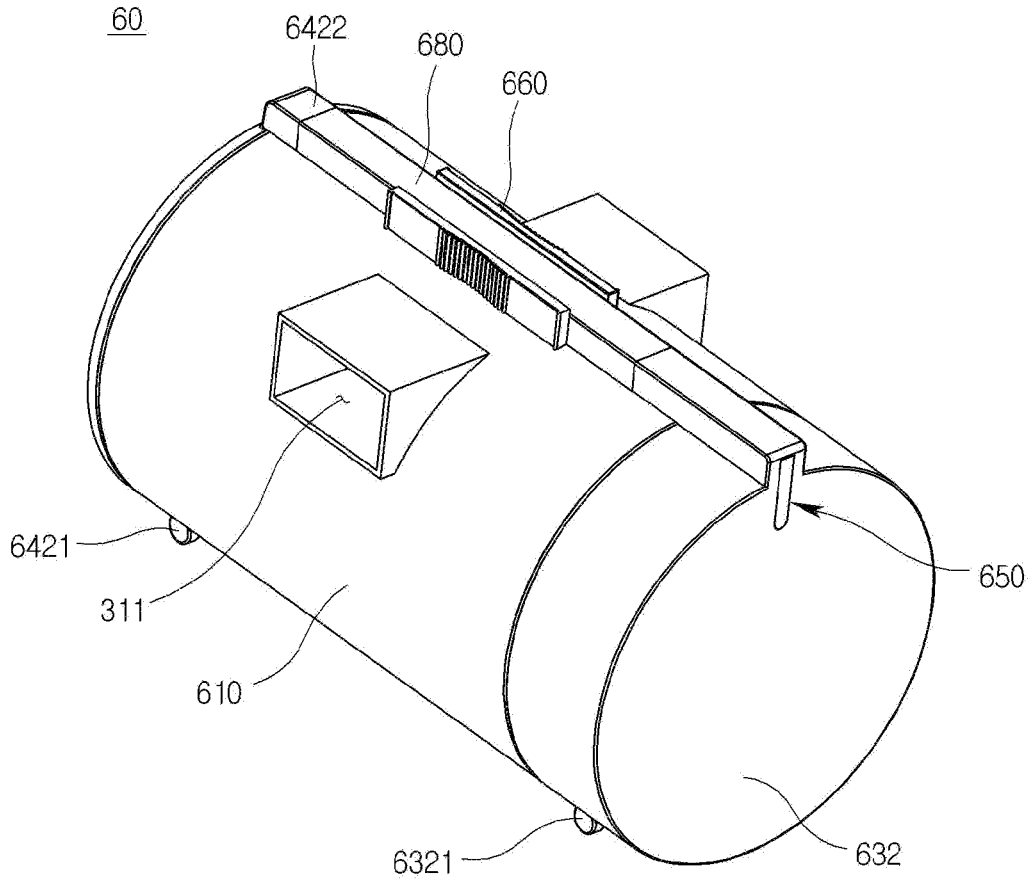
FIG. 2 is a perspective view of a dust bin according to the embodiment of the present invention.
Figure 3:
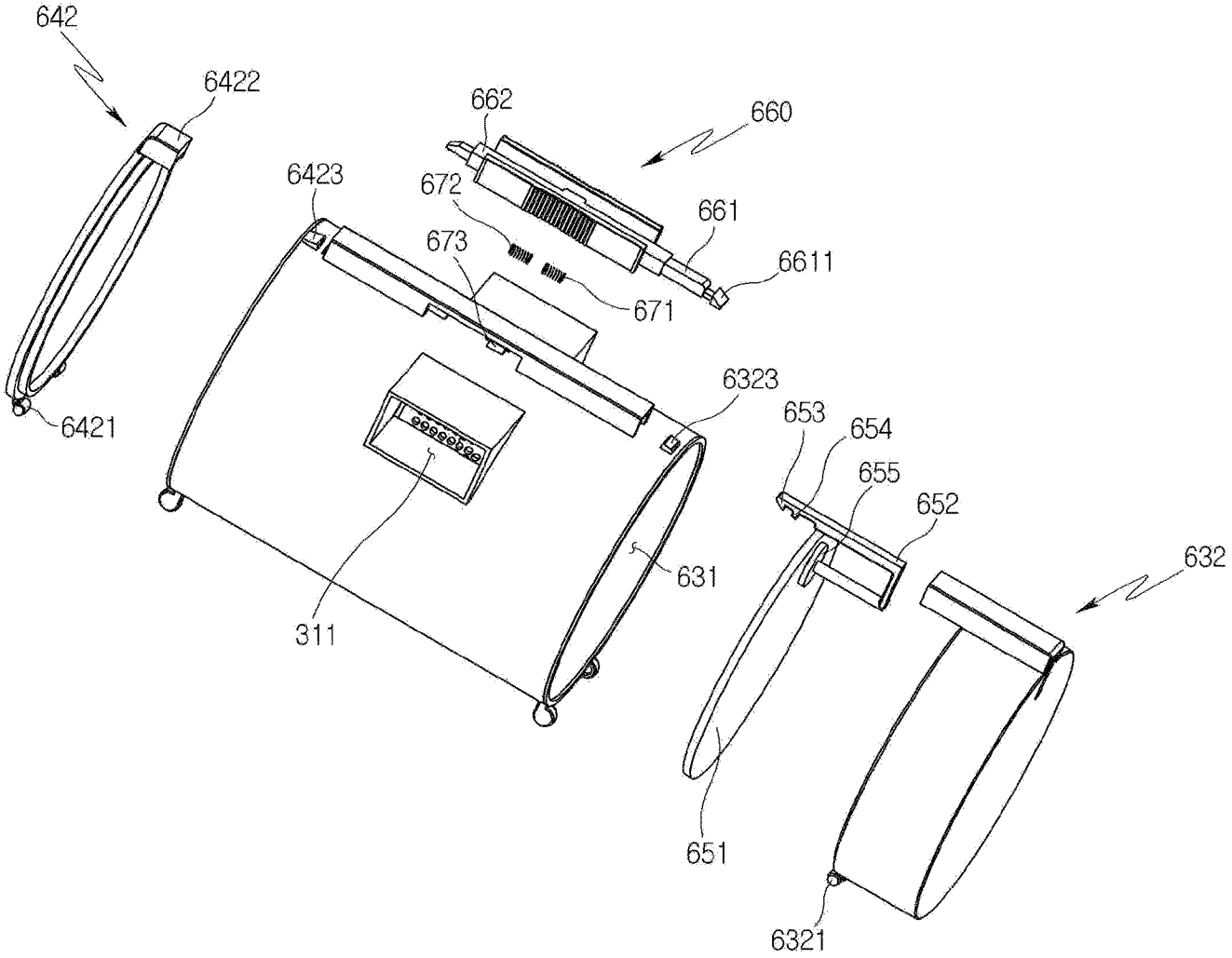
FIG. 3 is an exploded perspective view of the dust bin according to the embodiment of the present invention.
Figure 4:
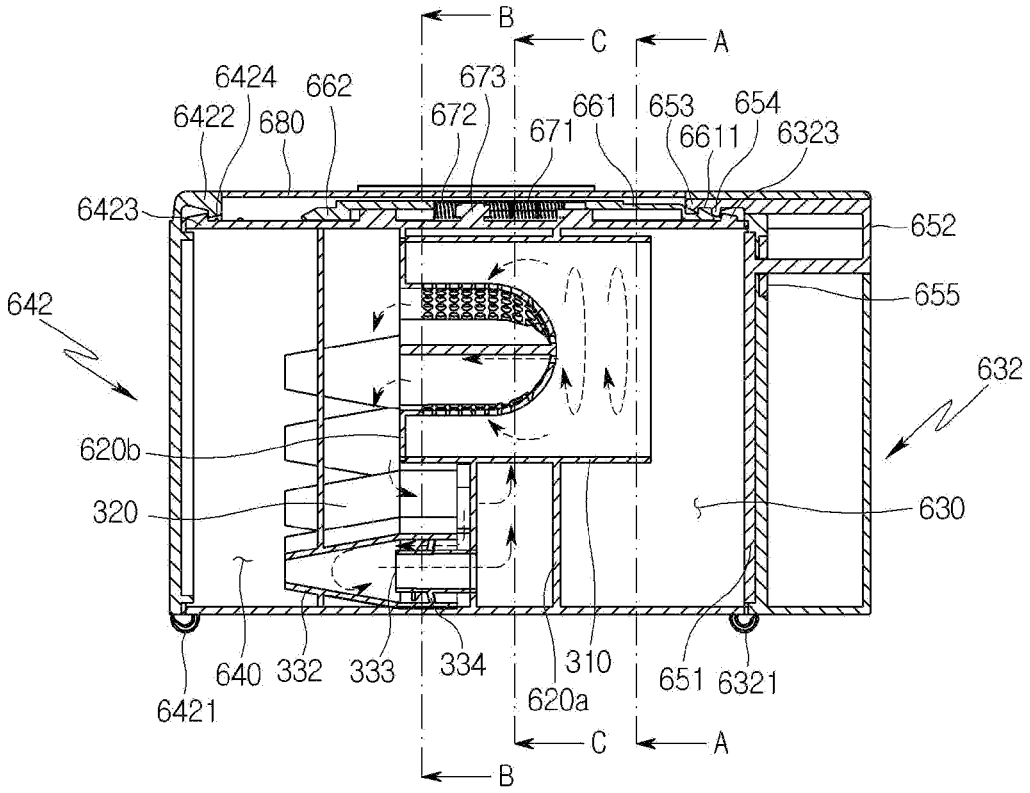
FIG. 4 is a cross-sectional view of the dust bin in FIG. 3 when viewed from the front side.

FIG. 1 is a perspective view of a cleaner 1 according to an embodiment of the present invention, FIG. 2 is a perspective view of a dust bin 60 according to the embodiment of the present invention, FIG. 3 is an exploded perspective view of the dust bin 60 according to the embodiment of the present invention, and FIG. 4 is a cross-sectional view of the dust bin 60 in FIG. 3 when viewed from the front side.

With reference to FIGS. 1 to 4, the cleaner 1 according to the embodiment of the present invention may include a main body 2. The main body 2 may include a suction part 10 configured to suck air containing dust.

A direction of one side, at which the suction part 10 is positioned, is defined as a forward direction based on a longitudinal axis A1 of the suction part 10, and a direction of the other side, at which a motor part 20 to be described below is positioned, is defined as a rearward direction. Based on the main body 2 illustrated in FIG. 1, a direction of an upper side is defined as an upward direction, and a direction of a lower side is defined as a downward direction.

An external shape of the main body 2 is defined by a housing 3.

The housing 3 has a handle 40.

The suction part 10 is coupled to a front side of the housing 3.

The dust bin 60 is coupled to the front side of the housing 3. An opening portion is formed in a coupling portion between the housing 3 and the dust bin 60, and the housing 3 and the dust bin 60 communicate with each other.

A power source part 50 is coupled to a lower portion of the housing 3.

The motor part 20 is coupled to an upper portion of the housing 3. The motor part 20 may be coupled to a rear upper portion of the housing 3.

The suction part 10 has a cylindrical shape opened therein and configured to suck the air containing dust. The suction part 10 may provide a suction flow path in which the air containing dust may flow. The air containing dust may be guided to the main body 2 through the suction part 10.

The suction part 10 communicates with an inlet port 311 of a cyclone part 30. The air sucked by a nozzle passes through the suction part 10 and is introduced into the cyclone part 30 through the inlet port 311.

The main body 2 may further include the motor part 20, the cyclone part 30, the handle 40, and the power source part 50.

In this case, the motor part 20 is configured to generate a flow of air (i.e., gas flow) so that the air containing dust may be introduced into the suction part 10. The motor part 20 may include a motor housing 20, and a suction motor (not illustrated) accommodated in the motor housing 20.

The suction motor (not illustrated) may include a motor shaft (not illustrated), and an impeller connected to the motor shaft and configured to rotate.

The suction motor (not illustrated) may be a brushless DC (BLDC) motor. The BLDC motor is a DC motor having no brush. Because the BLDC motor does not have a brush that is an abrasive component, the BLDC motor advantageously generates less mechanical noise and rotational noise without a problem with a high-speed rotation.

The motor part 20 is disposed on the longitudinal axis A1 of the suction part. A center of gravity of the motor part 20 is disposed on the longitudinal axis A1 of the suction part.

This arrangement may minimize the moment of force generated on the cleaner 1. More specifically, the main body 2 of the cleaner may be defined as a single rigid body. The air is introduced at a portion closer to the upper side based on the cleaner main body 2. In this case, if an air discharge port is formed at another position, an air introduction direction and an air discharge direction are different from each other, which may cause the moment of force, and the cleaner may rotate in one direction. As a result, a user may feel discomfort when operating the cleaner 1. However, in the cleaner 1 according to the present invention, the motor part 20 is disposed on the longitudinal axis A1 of the suction part, which may minimize the moment of force to be generated on the cleaner 1 and facilitate the operation of the cleaner 1.

The main body 2 may further include the dust bin 60 to store the dust separated by the cyclone part 30.

The inlet port 311 is provided at one side of the dust bin 60, a discharge port 331 is provided at the other side of the dust bin 60, and the cyclone part 30 is provided in the dust bin 60 and generates a cyclone flow.

The dust bin 60 includes a cylindrical casing 610. The casing 610 has the inlet port 311 through which the air is introduced into the dust bin 60, and the discharge port 331 through which the air is discharged to the outside of the dust bin 60.

With reference to FIG. 2, the inlet port 311 is provided to be directed toward the front side of the dust bin 60, and the discharge port 331 is provided to be directed toward the rear side of the dust bin 60.

The inlet port 311 and the discharge port 331 are provided in a circumferential direction of the dust bin 60. The inlet port 311 introduces the dust in the circumferential direction of the dust bin 60, such that the introduced air is subjected to a cyclone flow along an inner peripheral surface of the dust bin 60 or an outer peripheral surface of a cyclone filter 350.

A longitudinal axis of the inlet port 311 and a longitudinal axis of the discharge port 331 may be coaxially disposed. This defines a straight line A1 passing through the inlet port and the discharge port. The straight line passing through the inlet port and the discharge port 331 may be coaxial with the longitudinal axis A1 of the suction part.

An internal space of the casing 610 is divided into a first dust storage part 630 and a second dust storage part 640 by a separation wall 620.

The first dust storage part 630 is one of the internal spaces of the casing 610 and communicates with the inlet port 311.

With reference to FIG. 2, the first dust storage part 630 is provided at a right side of the separation wall 620. A first cyclone 310 is disposed in the first dust storage part 630 and primarily separates relatively large dust in the air introduced from the inlet port 311.

The first dust storage part 630 may have a cylindrical shape.

One end of the first dust storage part 630 is closed by a separating plate, and a first opening portion 631 is formed at the other end of the first dust storage part 630. The pieces of dust, which settle in the first dust storage part 630, are discharged to the outside through the first opening portion 631.

A first cap 632 is rotatably disposed in the first opening portion 631 of the first dust storage part 630. The first cap 632 closes the first opening portion 631 while the cleaner 1 operates. The first cap 632 opens the first opening portion 631 after the cleaner 1 operates, which may remove the dust settling in the first dust storage part 630.

The first cap 632 is a constituent element that selectively opens or closes the first opening portion 631. The first cap 632 covers the first opening portion 631.

A hinge is disposed at one side of the first cap 632, and a hook is disposed at the other side of the first cap 632. With reference to FIG. 3, a first cap hinge 6321 is disposed at a lower end of the first cap 632. The first cap 632 rotates about the first cap hinge 6321 and opens or closes the first opening portion 631. With reference to FIG. 3, a first cap hook 653 is disposed at an upper end of the first cap 632. The first cap hook 653 is caught by a first cap protrusion 6323, such that the first cap 632 is fixed while closing the first opening portion 631. The first cap hook 653 is unfastened by a lever 660.

A compression member 650 may be disposed on the first cap 632. The compression member 650 will be described below.

The second dust storage part 640 is one of the internal spaces of the casing 610 and communicates with the discharge port 331. With reference to FIG. 2, the second dust storage part 640 is provided at a left side of the separating plate. Second cyclones 330 are disposed in the second dust storage part 640 and secondarily separate relatively fine dust in the air introduced from the inlet port 311.

The second dust storage part 640 may have a cylindrical shape.

One end of the second dust storage part 640 is closed by the separating plate, and a second opening portion 641 is formed at the other end of the second dust storage part 640. The pieces of dust, which settle in the second dust storage part 640, are discharged to the outside through the second opening portion 641.

A second cap 642 is a constituent element that selectively opens or closes the second opening portion 641. The second cap 642 covers the second opening portion 641.

A hinge is disposed at one side of the second cap 642, and a hook is disposed at the other side of the second cap 642. With reference to FIG. 3, a second cap hinge 6421 is disposed at a lower end of the second cap 642. The second cap 642 rotates about the second cap hinge 6421 and opens or closes the second opening portion 641. With reference to FIG. 3, a second cap hook 6422 is disposed at an upper end of the second cap 642. The second cap hook 6422 is caught by a second cap protrusion 6423, such that the second cap 642 is fixed while closing the second opening portion 641. The second cap hook 6422 is unfastened by the lever 660.

The first opening portion 631 and the second opening portion 641 are opposite to each other. With reference to FIG. 2, the first opening portion 631 is formed at a right end of the casing 610, and the second opening portion 641 is formed at a left end of the casing 610. The first opening portion 631 and the second opening portion 641 are spatially spaced apart from each other, which makes it possible to distinguish and discharge the large dust and the small dust.

The separation wall 620 is a constituent element that divides the internal space of the dust bin 60 into the first dust storage part 630 and the second dust storage part 640. At least a part of the first cyclone 310 penetrates the separation wall 620. The separation wall 620 includes a first separation wall 620*a* and a second separation wall 620*b*.

The first separation wall 620*a* extends radially outward from an outer peripheral surface of the first cyclone 310. The second separation wall 620*b* extends radially inward from an inner peripheral surface of the first cyclone 310. The second separation wall 620*b* may extend radially outward from the outer peripheral surface of the first cyclone 310.

The first separation wall 620*a* extends radially outward from a lateral side of the first cyclone 310. The first separation wall 620*a* separates the first dust storage part 630 and the second dust storage part 640.

The second separation wall 620*b* extends radially inward or radially outward from an end of the first cyclone 310. The second separation wall 620*b* closes one side end of the first cyclone 310.

At least a part of the first cyclone 310 is inserted into the first separation wall 620*a*. One side of the first cyclone 310 is closed by the second separation wall 620*b*.

The first cyclone 310 is disposed to be spaced apart from the dust bin 60. The separation wall 620 is supported by the dust bin 60 and supports the first cyclone 310.

The separation wall 620 divides the internal space of the casing 610 so that the first dust storage part is disposed at one side and the second dust storage part 640 is disposed at the other side based on the straight line A1 passing through the inlet port and the discharge port. The straight line A1 passing through the inlet port and the discharge port is coaxial with the longitudinal axis A1 of the suction part. In this arrangement, the first dust storage part 630 and the second dust storage part 640 are disposed in the spaces spaced apart from each other at two opposite sides of the flow of the introduced air, such that the large dust and the small dust may be easily stored in the different spaces.

The separation wall 620 is disposed in parallel with a direction in which the air is introduced into the inlet port 311. In other words, the separation wall 620 is disposed in parallel with the straight line A1 passing through the inlet port and the discharge port. The separation wall 620 separates the first dust storage part 630 and the second dust storage part 640 at the left and right sides when viewed from the front side. With this arrangement, the large dust and the small dust may be easily stored in the different spaces at two opposite sides of the flow of the introduced air.

The separation wall 620 is disposed to be perpendicular to an axis A2 of a first cyclone flow or an axis A3 of a second cyclone flow. In other words, the separation wall 620 extends in a forward/rearward direction.

With reference to FIG. 4, the separation wall 620 includes a communication hole 621.

The communication hole 621 allows the first dust storage part 630 and the second dust storage part 640 to communicate with each other.

The communication hole 621 is formed through one side of the separation wall 620. The communication hole 621 is disposed in the first cyclone 310.

The communication hole 621 is disposed to be closer to an upper side of the separation wall 620. With reference to FIG. 4, the communication hole 621 is disposed to be closer to the upper side, and the first cyclone 310 is also disposed to be closer to the upper side of the separation wall 620. The first cyclone 310 surrounds the communication hole 621.

In case that the separation wall 620 includes the first separation wall 620*a* and the second separation wall 620*b*, the communication hole 621 is formed in the second separation wall 620*b*.

The cyclone filter 350 is disposed in the communication hole 621.

The cyclone part 30 may communicate with the suction part 10. The cyclone part 30 adopts a principle of a dust collector using a centrifugal force to separate the dust sucked into the main body 2 through the suction part 10.

For example, the cyclone part 30 may include the first cyclone 310 capable of separating dust by using a cyclone flow. The first cyclone 310 may communicate with the suction part 10. The air and dust introduced through the suction part 10 spirally flows along an inner peripheral surface of the first cyclone 310. The axis A2 of the cyclone flow in the first cyclone 310 may extend to left and right lateral sides.

The cyclone part 30 may further include the second cyclone 330 configured to separate dust again from the air discharged from the first cyclone 310. The second cyclone 330 may include a plurality of cyclone bodies disposed in parallel. The air discharged from the first cyclone 310 may be separated and pass through the plurality of cyclone bodies.

In this case, the axis A3 of the cyclone flow in the second cyclone 330 may also extend to the left and right lateral sides. The axis A2 of the cyclone flow in the first cyclone 310 and the axis A3 of the cyclone flow in the second cyclone 330 are disposed in parallel.

The axes A2 and A3 of the cyclone flows may be disposed to be perpendicular to the longitudinal axis A1 of the suction part. More specifically, the axes A2 and A3 of the cyclone flows may be disposed to be perpendicular to both the longitudinal axis A1 of the suction part and a longitudinal axis A4 of the handle. With reference to FIG. 4, the axes A2 and A3 of the cyclone flows may be disposed to be perpendicular to the longitudinal axis A1 of the suction part and parallel to the ground surface. Therefore, the sucked air flows rearward in the longitudinal axis A1 of the suction part and is introduced into the cyclone part 30 in a direction perpendicular to the axis A3 of the cyclone flow.

The cyclone part 30 may be disposed below the suction part 10. The suction part 10 includes pieces of dust with various sizes. If the cyclone part 30 is disposed above the suction part 10, there is a problem in that very large dust may settle between the cyclone part 30 and the suction part 10, the very large dust remains between the cyclone part 30 and the suction part 10 without merging into the cyclone flow. Therefore, the cyclone part 30 is disposed below the suction part 10, such that the dust is smoothly introduced into the cyclone part 30.

The first cyclone 310 and the second cyclone 330 are disposed in the spaces spaced apart from each other with the separation wall 620 interposed therebetween.

The first cyclone 310 is disposed at the right side of the separation wall 620 when viewed from the front side. The first cyclone 310 is disposed in the first dust storage part 630.

The first cyclone 310 has a cylindrical shape. The first cyclone 310 has a cylindrical shape having a center disposed on the axis A2 of the first cyclone flow. The axis A2 of the first cyclone flow is parallel to a central axis of the dust bin 60.

The axis A2 of the first cyclone flow is disposed in a leftward/rightward direction. More specifically, the axis A2 of the first cyclone flow is parallel to the ground surface. Therefore, the introduced air turns along the axis A2 of the first cyclone flow and is accumulated on a bottom of the first cyclone 310.

The inlet port 311 is provided at one side of the first cyclone 310. The inlet port 311 connects the suction part 10 and the first cyclone 310. A front end of the inlet port 311 communicates with the suction part 10, and a rear end of the inlet port 311 communicates with the first cyclone 310.

The inlet port 311 is disposed to be closer to one side of the first cyclone 310. More specifically, with reference to FIG. 5, the inlet port 311 is provided in the outer peripheral surface of the first cyclone 310. The inlet port 311 is provided in the circumferential direction of the first cyclone 310 and introduces the air into the first cyclone 310 in the circumferential direction. Therefore, the air introduced into the first cyclone 310 is subjected to the cyclone flow along the axis A2 of the first cyclone flow.

At least a part of the first cyclone 310 is disposed and formed through the separation wall 620. In other words, the separation wall 620 extends outward from the outer peripheral surface of the first cyclone 310. Because at least a part of the first cyclone 310 is formed through the separation wall 620, a stroke distance of a compression plate 651 may further increase, and a large amount of large dust present in the first dust storage part 630 may be compressed.

The first cyclone 310 is disposed at an upper side of the first dust storage part 630. Therefore, the pieces of dust are accumulated on a lower space of the first cyclone 310.

The inlet port 311 is disposed in a radial direction of the longitudinal axis A1 of the suction part and disposed in a radial direction of the axis of the cyclone flow. In other words, the inlet port 311 is disposed at an intersection point between the longitudinal axis A1 of the suction part and the axis of the cyclone flow.

The axis A2 of the first cyclone flow intersects the longitudinal axis A1 of the suction part and is perpendicular to the longitudinal axis A4 of the handle. More specifically, the axis A2 of the first cyclone flow is perpendicular to both the longitudinal axis A1 of the suction part and the longitudinal axis A4 of the handle.

The inlet port 311 is disposed on the longitudinal axis A1 of the suction part. With the above-mentioned arrangement, the air is introduced into the first cyclone 310 while having minimum resistance. Therefore, an active cyclone flow may be generated in the first cyclone 310.

In the first cyclone 310, the air rotates around the cyclone filter 350.

One side of the first cyclone 310 is closed, and other side of the first cyclone 310 is opened. With reference to FIG. 4, a left end of the first cyclone 310 is closed by the second separation wall 620*b*, and a right end of the first cyclone 310 is opened. The communication hole 621 is formed in the second separation wall 620*b*, such that the air present in the first cyclone 310 flows to the second cyclone 330. The opening portion of the first cyclone 310 communicates with the first dust storage part 630, such that the pieces of dust settling on the bottom of the first cyclone 310 are dropped into the first dust storage part 630 by gravity.

The axis A2 of the first cyclone flow intersects the longitudinal axis A1 of the suction part. More specifically, the axis A2 of the first cyclone flow is perpendicular to the longitudinal axis A1 of the suction part and parallel to the ground surface. In other words, the axis A2 of the first cyclone flow is perpendicular to the straight line passing through the inlet port 311 and the discharge port. The longitudinal axis A1 of the suction part is coincident with the circumferential direction of the first cyclone 310. Therefore, the dust introduced from the suction part 10 generates the cyclone flow in the first cyclone 310. The dust may be quickly separated from the air by the gravity and the centrifugal force made by the cyclone flow.

The cyclone part 30 may be disposed below the suction part 10.

The second cyclone 330 may be disposed at the left side of the separation wall 620 when viewed from the front side. The second cyclone 330 is disposed in the second dust storage part 640.

The second cyclone 330 has a cylindrical shape. The second cyclone 330 has a cylindrical shape having a center disposed on the axis A3 of the second cyclone flow. The axis A3 of the second cyclone flow is parallel to the central axis of the dust bin 60.

The second cyclone includes an outer tube 332 and an inner tube 333. A flow in the second cyclone 330 may be formed between the outer tube 332 and the inner tube 333.

With reference to FIG. 4, a gap is formed between the outer tube 332 and the inner tube 333 of the second cyclone 330. The air having passed through the cyclone filter 350 is introduced into the gap between the outer tube 332 and the inner tube 333 of the second cyclone 330.

An end of the outer tube 332 may have a conical shape having a diameter that gradually decreases.

The second cyclone 330 includes blades 334. The blade 334 assists in generating the cyclone flow in the second cyclone 330.

The blade 334 is formed between the outer tube 332 and the inner tube 333 of the second cyclone 330. The blade 334 generates a swirl flow in one direction. The blade 334 may generate a cyclone flow counterclockwise when viewed from the left side.

The dust may be quickly separated from the air by the gravity and the centrifugal force made by the cyclone flow.

The air is subjected to a cyclone flow in a space between the outer tube 332 and the inner tube 333. The air, which is subjected to the cyclone flow, may be discharged to the outside through the inner tube 333. With reference to FIG. 4, the dust is separated to the left side of the second cyclone 330, and the air flows to the right side of the second cyclone 330.

The second cyclone 330 may be provided as a plurality of second cyclones 330 disposed along the outer peripheral surface of the first cyclone 310. With reference to FIG. 4, the second cyclone 330 may be disposed at the left side, the lower side, and the right side of the first cyclone 310. The air introduced into the second dust storage part 640 from the cyclone filter 350 may have a rotating flow. With this arrangement, the air may be equally introduced into the second cyclones 330.

The axis A3 of the second cyclone flow may be disposed in the leftward/rightward direction. More specifically, the axis A2 of the first cyclone flow is parallel to the ground surface. Therefore, the introduced air turns along the axis A3 of the second cyclone flow and is accumulated on a bottom of the second cyclone 330.

The discharge port 331 is provided at one side of the second dust storage part 640. The front end of the discharge port 331 communicates with the second dust storage part 640, and the rear end of the discharge port 331 communicates with the housing 3 or the motor part 20.

The discharge port 331 is provided in the outer peripheral surface of the dust bin 60 and discharges the air to the outside in the circumferential direction.

A direction in which the air is discharged from the discharge port 331 may be disposed in parallel with a direction in which the air is introduced into the inlet port 311. More specifically, the direction in which the air is discharged from the discharge port 331 may be coaxial with the direction in which the air is introduced into the inlet port 311.

The axis A3 of the second cyclone flow is perpendicular to the longitudinal axis A1 of the suction part and parallel to the ground surface. In other words, the axis A3 of the second cyclone flow is perpendicular to the straight line A1 passing through the inlet port and the discharge port.

The axis A3 of the second cyclone flow intersects the longitudinal axis A1 of the suction part and is perpendicular to the longitudinal axis A4 of the handle. More specifically, the axis A3 of the second cyclone flow is perpendicular to both the longitudinal axis A1 of the suction part and the longitudinal axis A4 of the handle.

Figure 5:
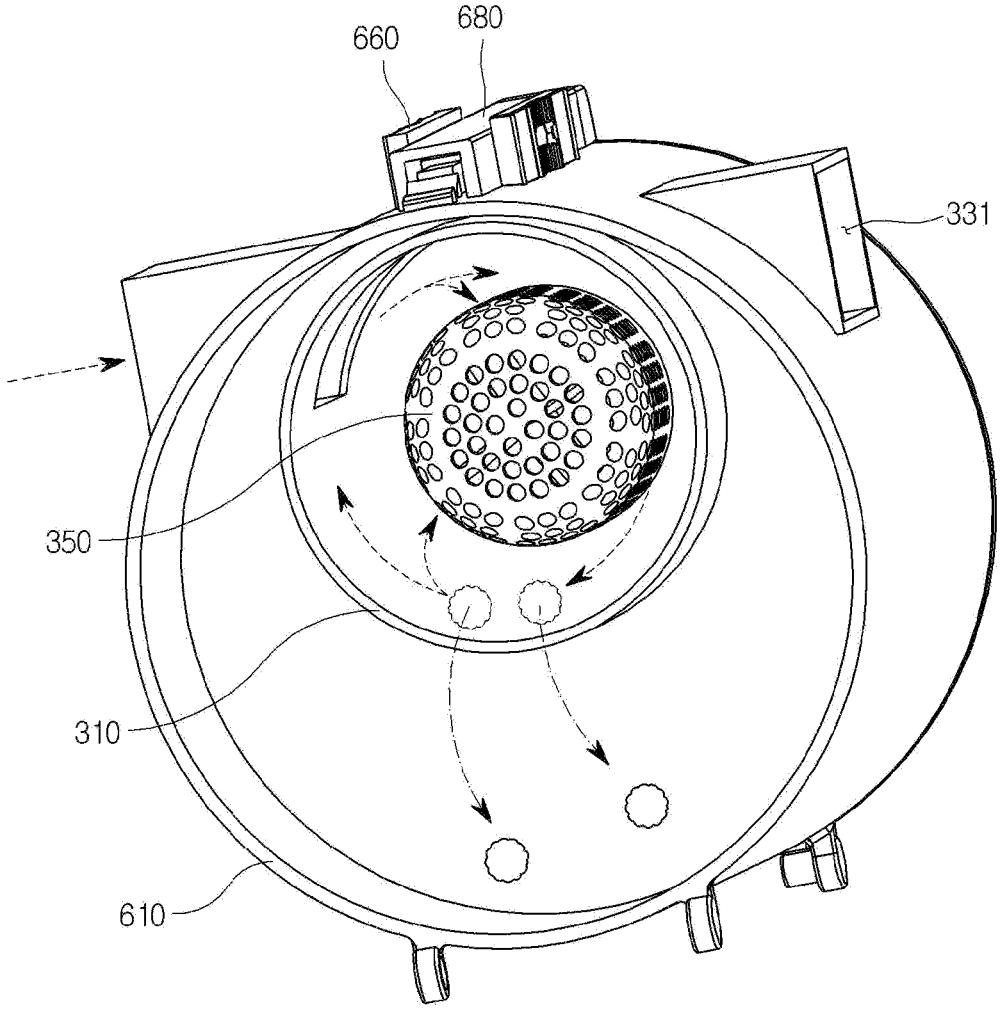
FIG. 5 is a cross-sectional view in direction A in FIG. 4.
Figure 6:
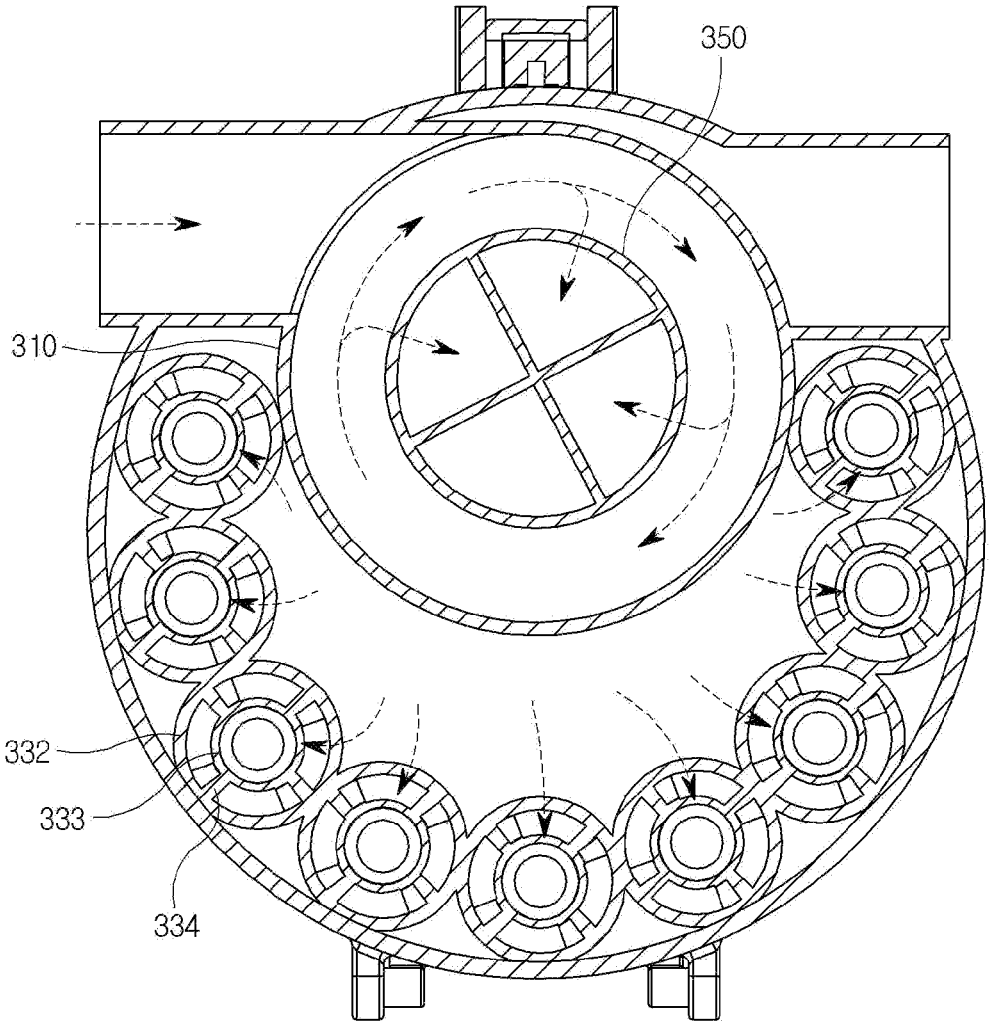
FIG. 6 is a cross-sectional view in direction B in FIG. 4.
Figure 7:
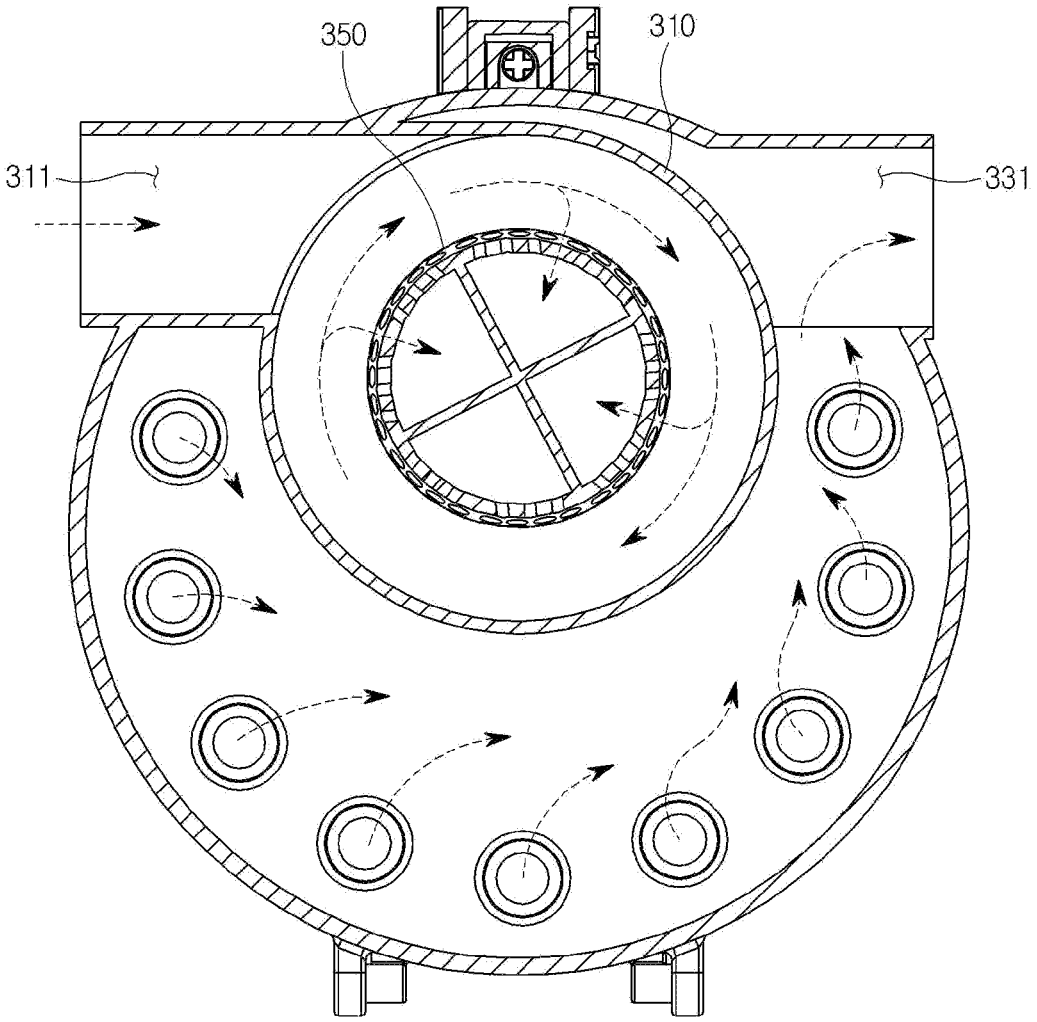
FIG. 7 is a cross-sectional view in direction C in FIG. 4.

With reference to FIGS. 4 and 5, the cyclone part 30 further includes the cyclone filter 350 disposed in the communication hole 621. The cyclone filter 350 guides the air, which is separated from the dust in the first cyclone 310, to the second cyclone 330. The cyclone filter 350 filters out the dust while the air passes through the cyclone filter 350.

The cyclone filter 350 is disposed between the first cyclone 310 and the second cyclone 330. The cyclone filter 350 is disposed in the communication hole 621.

To this end, the cyclone filter 350 may include a mesh portion having a plurality of holes. The mesh portion may be made of a metallic material. However, the present invention is not limited thereto.

At least a part of the cyclone filter 350 protrudes in the direction of the first dust storage part 630. The cyclone filter 350 may have a cup shape protruding in the direction of the first dust storage part 630.

If the cyclone filter 350 protrudes in the direction of the first dust storage part 630, there is a problem in that the filtered-out dust is accumulated in the cyclone filter 350. On the contrary, the cyclone filter 350 according to the present invention protrudes in the direction of the first dust storage part 630, such that the dust is scattered again by the air in the cyclone flow even though a part of the dust settles in the cyclone filter 350. As a result, the dust does not settle in the cyclone filter 350, which may maintain a cleanliness state.

In the first cyclone 310, the air rotates around the cyclone filter 350. Apart of the air rotates along the outer peripheral surface of the cyclone filter 350, and the remaining air may flow to the second dust storage part 640 while passing through the cyclone filter 350.

The compression member 650 is a constituent element disposed in the first dust storage part 630 and configured to compress the large dust settling in the first dust storage part 630.

With reference to FIGS. 3 and 4, the compression member 650 includes the compression plate 651 disposed in the first cap 632 and configured to reciprocate in a first chamber.

The compression plate 651 is disposed in the first cap 632. The first cap 632 may have a depressed portion formed at position facing the first opening portion 631. At least a part of the compression plate 651 is inserted into the depressed portion of the first cap 632. The compression plate 651 may be installed in the first cap 632 and disposed on the first opening portion 631, and the compression plate 651 may close the first opening portion 631.

The compression plate 651 is formed in a cross-sectional shape of the first dust storage part. The first opening portion 631 has a circular cross-sectional area when viewed from the right side. The compression plate 651 may be formed as a circular plate along a shape of the cross-sectional area of the first opening portion 631. With reference to FIG. 4, the compression plate 651 slides from the right side to the left side, and the compression plate 651 moves, such that the dust is compressed while being pushed and moved toward the separation wall 620.

With reference to FIGS. 3 and 4, the compression member 650 includes a compression plate guide bar 652.

The compression plate guide bar 652 is coupled to one side of the compression plate 651. With reference to FIG. 4, the compression plate guide bar 652 extends from the upper side to the right side of the compression plate 651. However, the present invention is not limited thereto. The compression plate guide bar 652 may be coupled to a lower side or other sides of the compression plate 651 within a range that may be easily adopted by those skilled in the art.

The compression plate guide bar 652 is provided in the form of a cantilevered beam.

The compression plate guide bar 652 penetrates the first cap 632. The first cap 632 has a through-hole into which the compression plate guide bar 652 is inserted. The compression plate guide bar 652 may move while passing through the through-hole.

One end of the compression plate guide bar 652 is coupled to a guide plate, and the other end of the compression plate guide bar 652 is connected to the lever 660. When the lever 660 moves in a second direction, the compression plate guide bar 652 moves along the lever 660, and the guide plate is compressed.

With reference to FIGS. 3 and 4, the compression member 650 includes a packing 655. The packing 655 is a constituent element that prevents the dust from leaking through the through-hole penetrated by the compression plate guide bar 652.

The packing 655 is penetrated by the compression plate guide bar 652.

The packing 655 is disposed on an outer surface of the first cap 632. The depressed portion of the first cap 632 may be formed at a position at which the packing 655 is inserted, and the packing 655 may be inserted into the depressed portion, such that the outer teeth are fixed.

With reference to FIG. 4, the first cap 632 may define a dual cover including a first outer cap and a first inner cap. In this case, the packing 655 is disposed on an outer surface of the first inner cap. The reason is that inside air may leak through the through-hole when the air is compressed as the compression plate 651 moves to the left side. To prevent a leak of air, the packing 655 needs to be disposed on the outer surface of the first inner cap. The packing 655 is kept in position by a frictional force between the packing 655 and the compression plate guide bar 652 and prevents a leak of the compressed air.

With reference to FIG. 2, the lever 660 selectively opens the first cap 632 or the second cap 642.

The lever 660 includes a first lever 661 extending in the direction of the first cap 632 and configured to open the first cap 632, and a second lever 662 extending in the direction of the second cap 642 and configured to open the second cap 642. The first lever 661 and the second lever 662 may be integrated.

The first cap hook 653 and the second cap hook 6422 may be disposed on a straight line together with a rail 680. Therefore, when the lever 660 moves in a first direction, the first cap hook 653 is unfastened, such that the first cap 632 is opened. When the lever 660 moves in the second direction, the second cap hook 6422 is unfastened, such that the second cap 642 is opened.

The first cap hook 653 and the second cap hook 6422 are disposed at two opposite sides based on the rail 680. Therefore, the first cap 632 and the second cap 642 may be selectively opened, and the user may sequentially remove the dust in the first dust storage part and the dust in the second dust storage part 640. In addition, when the lever 660 moves in the second direction, the compression plate 651 compresses the dust in the first dust storage part 630 by moving at the same time when the second cap 642 is opened.

The lever 660 opens the first cap 632. In case that the lever 660 moves in the first direction, the first cap 632 is opened. The first direction is a direction from the lever 660 to the first cap 632.

Figure 9:
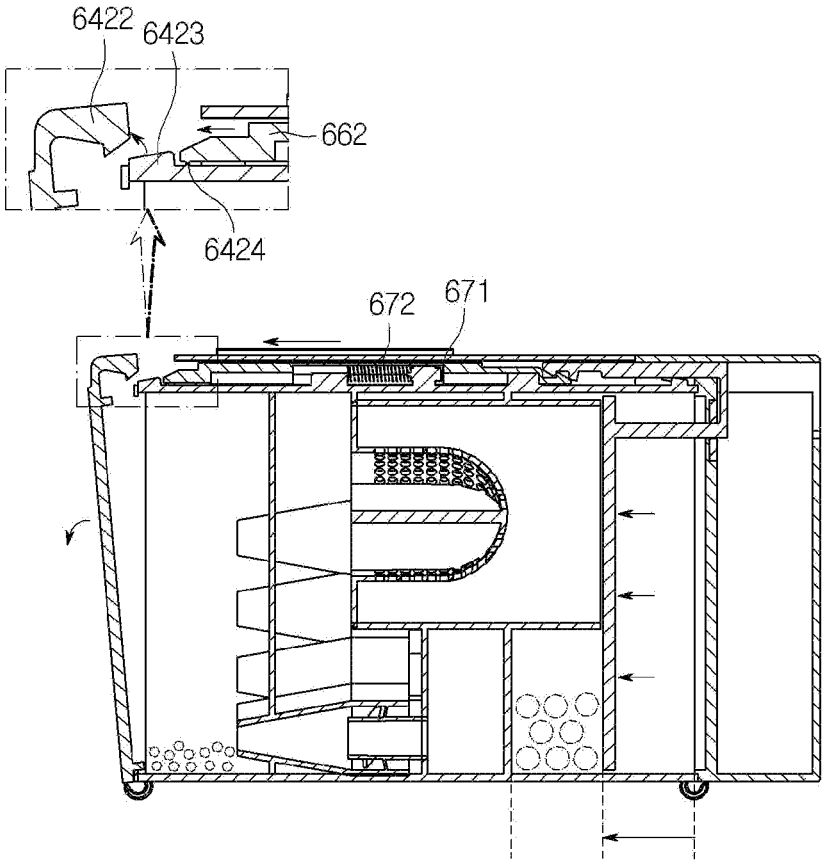
FIG. 9 is a cross-sectional view of the dust bin when a lever in FIG. 8 is moved in a direction of a second cap and opens the second cap.
Figure 10:
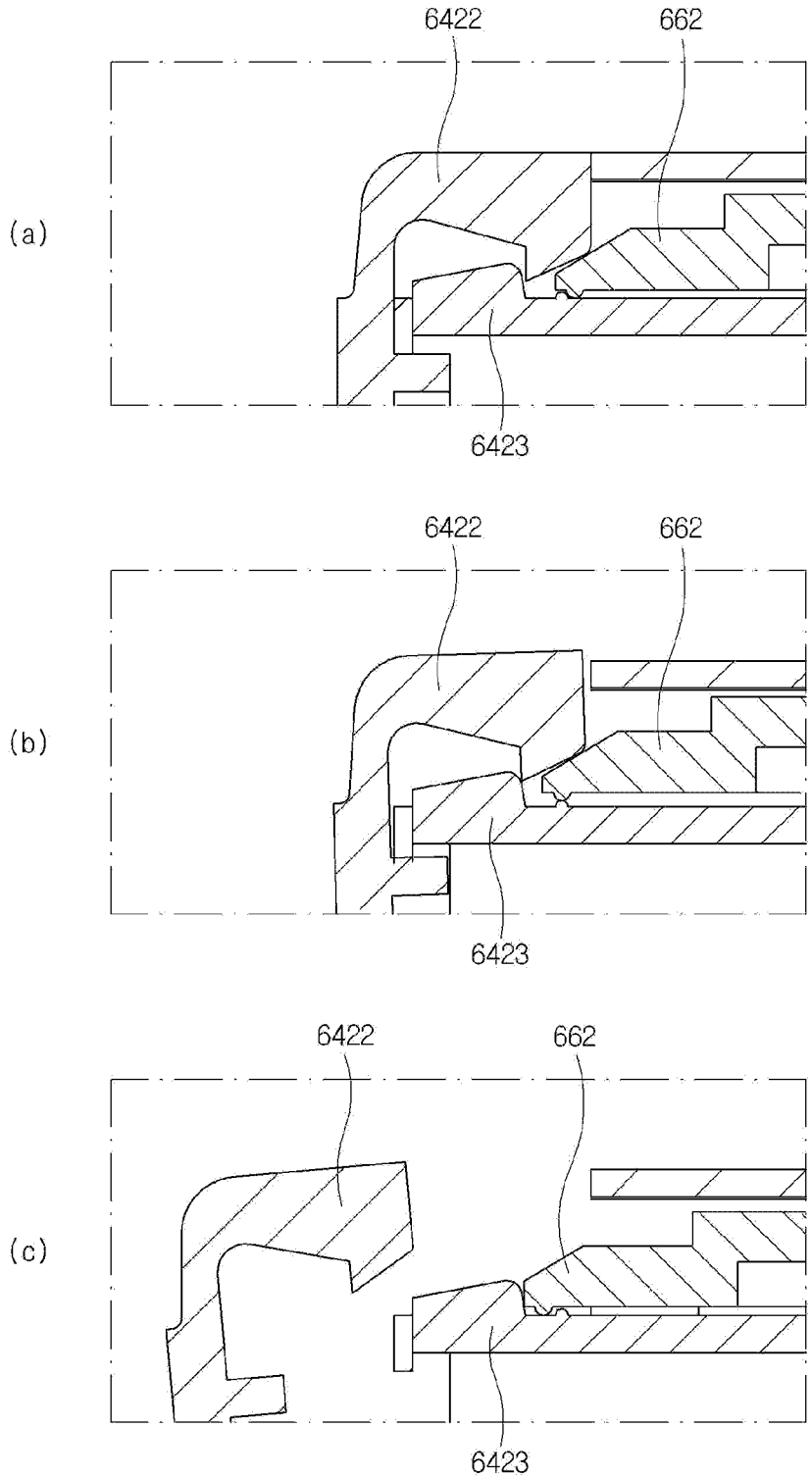
FIG. 10 is an enlarged view of a second cap hook part before and after the second cap in FIG. 9 is opened.
Figure 11:
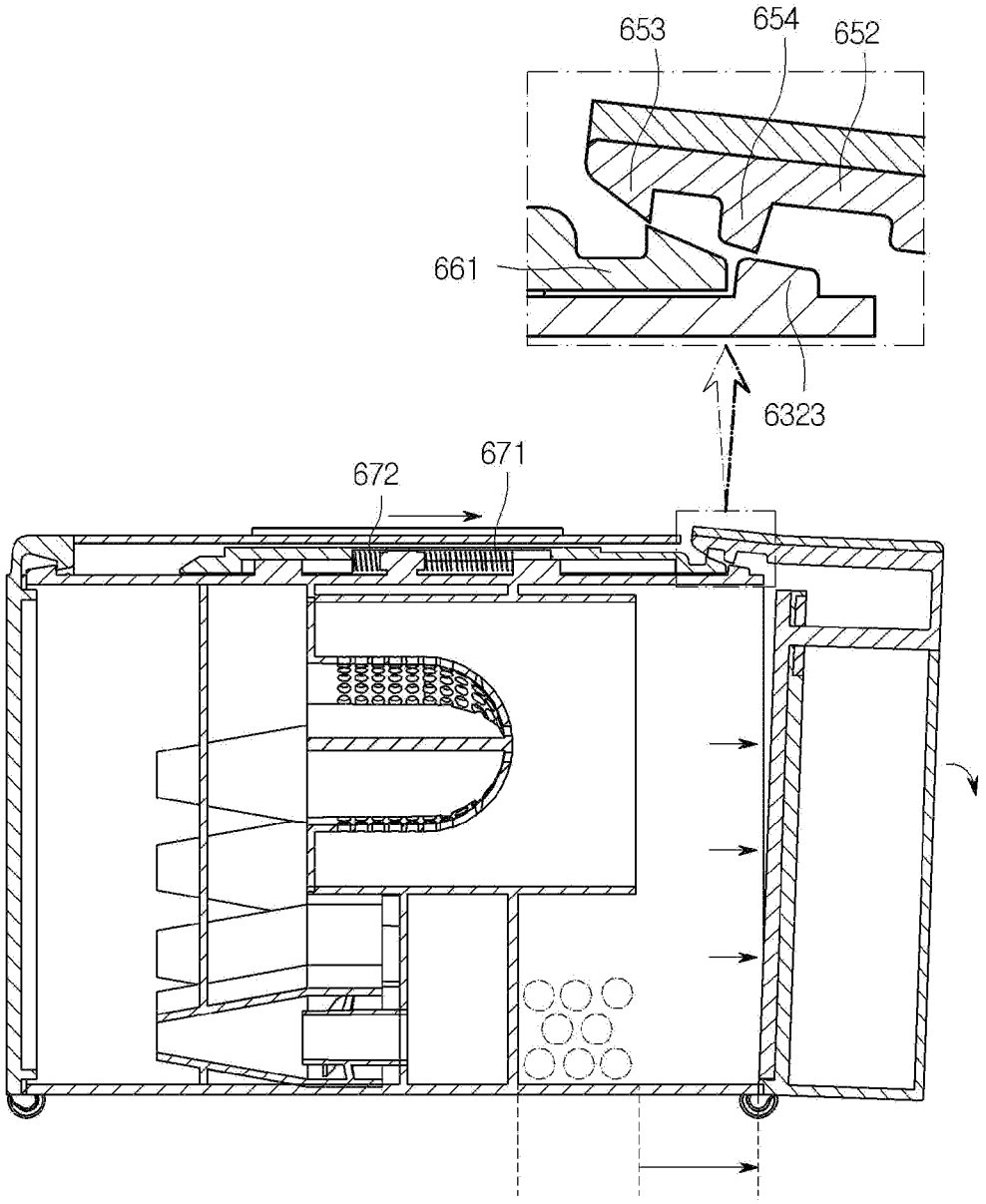
FIG. 11 is a cross-sectional view of the dust bin when the lever in FIG. 9 is moved in a direction of a first cap and opens the first cap.
Figure 12:
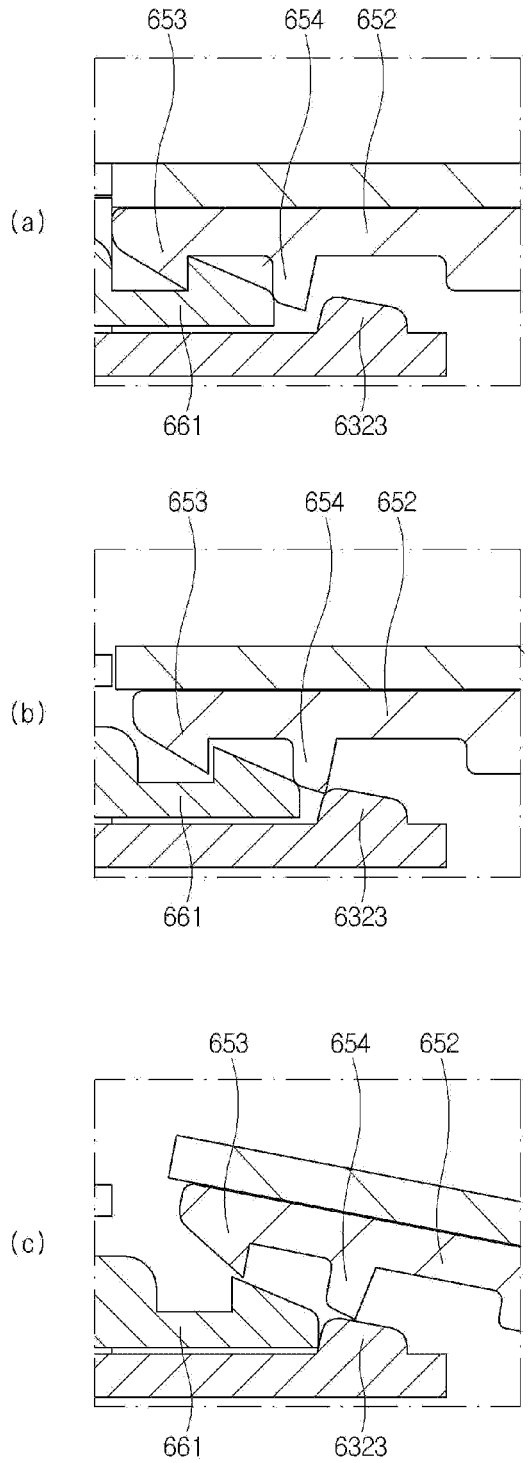
FIG. 12 is an enlarged view of a first cap hook part before and after the first cap in FIG. 10 is opened.

FIG. 11 is a cross-sectional view illustrating a state in which the first cap is opened as the lever moves in the direction of the first cap after the fine dust collected in the second dust storage part in FIG. 9 is removed. FIG. 12 is an enlarged view of a first cap hook part before and after the first cap in FIG. 10 is opened. That is, in FIG. 11, as the lever moves in the first direction, the first cap is opened, and the compressed dust collected in the first dust storage part 630 is removed.

With reference to FIG. 11, at least a part of the first cap hook 653 is caught by the lever 660. The first cap hook 653 is provided at an end of the compression plate guide bar 652. The lever 660 has a first lever hook 6611 fastened to the first cap hook 653. The first lever hook 6611 is provided at an end of the first lever 661.

In case that the first cap hook 653 is fastened to the first lever hook 6611, the first cap 632 closes the first opening portion 631.

The first lever 661 unfastens the first cap hook 653 and the first lever hook 6611.

The compression plate 651 includes a first release protrusion 654 disposed outside the first lever hook 6611 and protruding toward the lever 660. The first release protrusion 654 raises the compression plate guide bar 652. In case that the compression plate guide bar 652 is raised, the first cap hook 653 and the first lever hook 6611 are unfastened.

The first lever 661 and the compression plate guide bar 652 are disposed on a straight line. More specifically, the first lever 661, the first cap hook 653, and a second release protrusion 6424 are disposed to overlap one another in the upward/downward direction.

The right end of the first lever 661 has a surface inclined leftward and upward. Therefore, the second lever 662 is inserted into a lower end of the second release protrusion 6424 and pushes the second release protrusion 6424 upward. In case that the second release protrusion 6424 is pushed upward, the first cap hook 653 is also pushed upward, such that the first cap hook 653 is unfastened from the first lever 661. Therefore, the first cap 632 is opened while rotating about the first cap hinge 6321.

The lever 660 moves the compression plate 651 to compress the dust in the first dust storage part 630.

The end of the first cyclone 310 is disposed to be spaced apart from the compression plate 651. At least a part of the first cyclone 310 is disposed to penetrate the separation wall 620, such that the at least a part of the first cyclone 310 is disposed to be more distant from the compression plate 651. The first cyclone 310 is not present within a stroke distance of the compression plate 651. For example, even in case that the lever 660 is moved in the second direction to a critical distance, the end of the first cyclone 310 is spaced apart from the compression plate 651.

The lever 660 opens the second cap 642. In case that the lever 660 moves in the second direction, the second cap 642 is opened. The second direction in a direction from the lever 660 toward the second cap 642.

Figure 8:
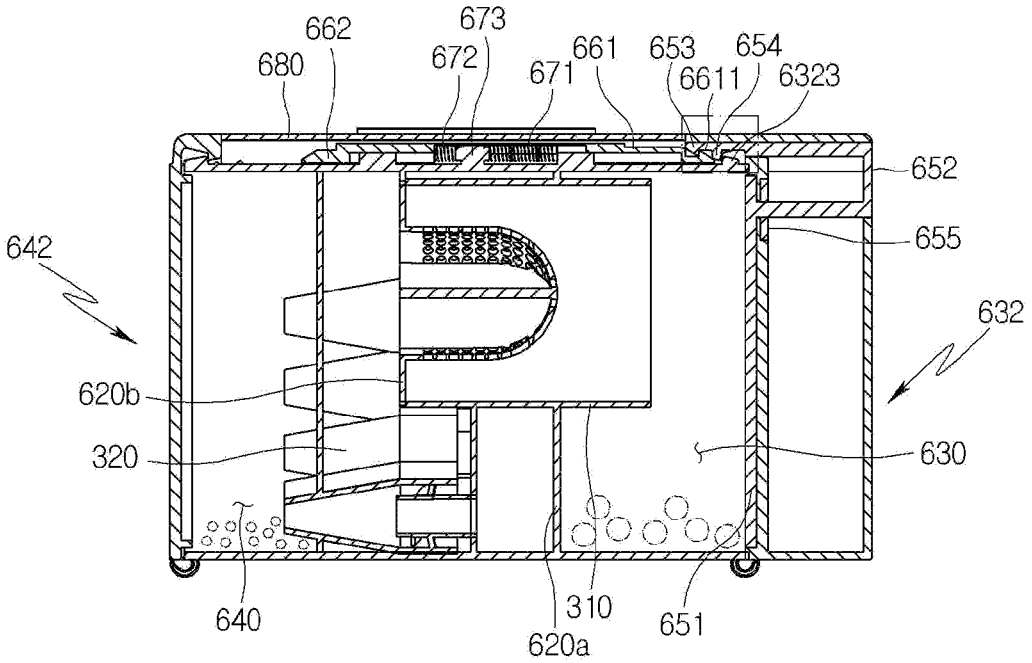
FIG. 8 is a cross-sectional view of the dust bin in which duct is collected when viewed from the front side.

FIG. 8 is a cross-sectional view illustrating the dust bin in a state in which the dust is collected after the cleaner operates when viewed from the front side. FIG. 9 is a cross-sectional view illustrating a state in which the second cap is opened as the lever in FIG. 8 in a direction of the second cap. FIG. 10 is an enlarged view of a second cap hook part before and after the second cap in FIG. 9 is opened. That is, in FIG. 9, as the lever moves in the second direction, the fine dust collected in the second dust storage part 640 is removed, and the large dust collected in the first dust storage part 630 is compressed.

With reference to FIG. 9, the second cap hook 6422 is fastened to the casing 610. The casing 610 includes the second cap protrusion 6423 formed at one side of the outer peripheral surface, and the second cap hook 6422 is caught by the second cap protrusion 6423.

The second cap hook 6422 is provided at the upper end of the second cap 642. The second cap protrusion 6423 protrudes from the upper end of the casing 610. The second cap hook 6422 is fastened to the second cap protrusion 6423. In case that the second cap hook 6422 is fastened to the second cap protrusion 6423, the second cap 642 closes the second opening portion 641.

The second lever 662 unfastens the second cap hook 6422 and the second cap protrusion 6423.

The second lever 662, the second cap hook 6422, and the second cap protrusion 6423 are disposed on a straight line. The left end of the second lever 662 has a surface inclined rightward and upward. The lower end of the second cap hook 6422 has a surface inclined rightward and upward to correspond to the inclined surface of the second lever 662. Therefore, the second lever 662 is inserted into a lower end of the second cap hook 6422 and pushes the second cap hook 6422 upward. In case that the second lever 662 is moved to the critical stroke distance at the left side, the second cap hook 6422 is unfastened, and the second cap 642 is opened while rotating about the second cap hinge 6421.

The casing 610 further includes the second release protrusion 6424 disposed between the second cap protrusion 6423 and the lever 660 and protruding upward. When the second lever 662 moves in the second direction, the lower surface of the second lever 662 slides along the upper end of the second release protrusion 6424. The second release protrusion 6424 pushes the second lever 662 upward. Therefore, the second cap hook 6422 may be further pushed upward and more easily unfastened.

The lever 660 surrounds at least a part of the rail 680.

The rail 680 protrudes outward from the outer peripheral surface of the casing 610 and extends toward at least any one of the first opening portion 631 and the second opening portion 641. With reference to FIG. 2, the rail 680 protrudes from the upper portion of the casing 610 and extends to the left and right sides.

When the lever 660 moves in one direction, the internal space of the first dust storage part 630 decreases, and the second dust storage part 640 is opened. For example, in case that the lever 660 moves in the second direction, the lever 660 moves the compression plate 651 in the second direction, such that the internal space of the first dust storage part 630 decreases, and the dust in the first dust storage part 630 is compressed. In case that the lever 660 moves to the critical distance in the second direction, the second cap hook 6422 is unfastened, and the second dust storage part 640 is opened.

An elastic member support protrusion 673 protrudes in an internal space of the rail 680. The elastic member support protrusion 673 supports an elastic member 670. A first elastic member 671 is supported at one side of the elastic member support protrusion 673, and a second elastic member 672 is supported at the other side of the elastic member support protrusion 673.

The elastic member 670 is disposed between the rail 680 and the lever 660.

The first elastic member 671 provides a restoring force when the lever 660 moves in the second direction. One end of the first elastic member 671 is supported on the elastic member support protrusion 673, and the other end of the first elastic member 671 supports the first lever 661.

The second elastic member 672 provides a restoring force when the lever 660 moves in the first direction. One end of the second elastic member 672 is supported on the elastic member support protrusion 673, and the other end of the second elastic member 672 supports the second lever 662.

When the lever 660 moves in the first direction, the first elastic member 671 is stretched, and the second elastic member 672 is compressed. Therefore, the lever 660 is restored to an original position by the second elastic member 672. On the contrary, when the lever 660 moves in the second direction, the first elastic member 671 is compressed, and the second elastic member 672 is stretched. Therefore, the lever 660 is restored to the original position by the first elastic member 671.

The handle 40 is configured to be gripped by the user and move the cleaner 1. The handle 40 may include a grip portion 450 disposed to be opposite to the suction part 10 based on the cyclone part 30 and configured to be gripped by the user's hand. In this case, the grip portion 450 has an approximately cylindrical shape and has the axis A4 in the longitudinal direction. In addition, the grip portion 450 may be disposed in a shape in which an upper portion thereof is inclined forward.

The power source part 50 is configured to supply electric power to the motor part 20 and includes a battery 510. An upper side of the power source part 50 is disposed adjacent to the handle 40, and a front side of the power source part 50 may be disposed adjacent to a part of a lower portion of the outer peripheral surface of the dust bin 60 to be described below.

A filter (not illustrated) is a constituent element disposed in an air flow path and configured to filter out the dust contained in the air. The filter (not illustrated) installed in the cleaner 1 according to the present invention includes a prefilter and a HEPA filter.

The prefilter may be a mesh filter having a cylindrical shape. For example, the prefilter may include a material such as nylon and spun-bonded non-woven fabric. The spun-bonded non-woven fabric is a kind of non-woven fabric made by distributing synthetic fibers made of polypropylene (PP) or the like and bonding the synthetic fibers by applying heat.

The HEPA filter (not illustrated) serves to finally filter out the fine dust that is not filtered out by the prefilter. The HEPA filter may be accommodated in the housing 3.

In the present invention, the configuration has been described in which the cleaner 1 includes the prefilter and the HEPA filter. However, the type of filter and the number of filters are not limited.

Hereinafter, an operation and effect of the cleaner 1 according to the present invention described above will be described.

With reference to FIGS. 2 and 4 to 7, the air sucked by the suction part 10 is separated from the dust while flowing through the cyclone part 30.

With reference to FIG. 5, the air is supplied from the inlet port 311 to the first cyclone 310. The first cyclone 310 generates the cyclone flow in the air. The air is primarily separated from the large dust in the first cyclone 310 and flows to the second cyclone 330 through the cyclone filter 350. The large dust separated in the first cyclone 310 is accumulated on the bottom of the first cyclone 310 or the bottom of the first dust storage part 630.

The second cyclone 330 generates the cyclone flow in the air. The air is secondarily separated from the dust in the second cyclone 330 and discharged through the discharge port 331. The fine dust separated in the second cyclone 330 is accumulated on the bottom of the second cyclone 330 or the bottom of the second dust storage part 640.

The relatively large dust is accumulated on the bottom of the first dust storage part 630, and the relatively fine dust is accumulated on the bottom of the second dust storage part 640. The large dust and the fine dust are accumulated in the spaces spaced apart from each other, which may provide an effect of distinguishing and treating the pieces of dust.

With reference to FIGS. 9 and 10, the lever may move in the second direction to discard the fine dust collected in the second dust storage part 640. More specifically, the lever may move in the second direction to open the second cap and discard the fine dust collected in the second dust storage part 640 and simultaneously move the compression plate to compress the large dust collected in the first dust storage part 630.

The lever is connected to the compression plate. Therefore, when the lever moves in the second direction, the compression plate reduces a volume of the first dust storage part 630 and compresses the large dust collected in the first dust storage part 630. When the lever further moves in the second direction, the end of the second lever of the lever moves the second cap hook 6422 upward to unfasten the second cap and opens the second cap to discard the fine dust in the second dust storage part 640.

With reference to FIGS. 10 to 12, the lever may move in the first direction to discard the large dust collected and compressed in the first dust storage part 630. The lever may move in the first direction to release the connection with the compression plate and simultaneously open the first cap to discard the large dust collected in the first dust storage part 630. When the lever moves in the first direction, the end of the first lever of the lever moves the first release protrusion 654 upward. In case that the first release protrusion 654 is raised, the first cap hook 653 is also raised, and the first cap hook and the lever are unfastened, such that the first cap is opened.

While the specific embodiments of the present invention have been described and illustrated, it is obvious to those skilled in the art that the present invention is not limited to the aforementioned embodiments and may be variously changed and modified without departing from the spirit and the scope of the present invention. Therefore, the scope of the present invention should be determined by the technical spirit of the appended claims instead of being determined by the described embodiment.

The invention claimed is:

1. A cleaner comprising:

a dust bin including an inlet port provided at a first side thereof, a discharge port provided at a second side thereof, and a cyclone part provided therein and configured to generate a cyclone flow; and a motor part that is in fluid communication with the dust bin and configured to generate a flow of air in the dust bin, wherein the dust bin comprises:

a casing at which the inlet port and the discharge port are provided, a separation wall dividing an internal space of the casing, a first dust storage part that is disposed in the internal space and that is in fluid communication, and with the inlet port;

a second dust storage part that is disposed in the internal space and that is in fluid communication with the discharge port, and wherein the separation wall includes a communication hole through which the first dust storage part and the second dust storage part are in fluid communication.

2. The cleaner of claim 1, further comprising:

a suction part that is in fluid communication with the inlet port and that is elongated in one direction, wherein the cyclone part comprises an axis of a cyclone flow that is perpendicular to a longitudinal axis of the suction part and parallel to a horizontal plane corresponding to the ground.

3. The cleaner of claim 2, wherein the inlet port is disposed on the longitudinal axis of the suction part.

4. The cleaner of claim 1, further comprising:

a suction part that is in fluid communication with the inlet port, wherein the cyclone part is disposed below the suction part.

5. The cleaner of claim 1, wherein the separation wall divides the internal space of the casing based on a straight line passing through the inlet port and the discharge port so that the first dust storage part is disposed at one side and the second dust storage part is disposed at the other side.

6. The cleaner of claim 1, wherein the separation wall is disposed in parallel with a direction in which air is introduced into the inlet port.

7. The cleaner of claim 1, wherein the cyclone part comprises a first cyclone disposed in the first dust storage part and having a cylindrical shape.

8. The cleaner of claim 7, wherein the inlet port is provided in a circumferential direction of the first cyclone.

9. The cleaner of claim 7, wherein at least a part of the first cyclone passes through the separation wall.

10. The cleaner of claim 7, wherein an axis of a cyclone flow in the first cyclone is provided in parallel with a horizontal plane corresponding to the ground.

11. The cleaner of claim 1, wherein the cyclone part further comprises a cyclone filter disposed in the communication hole.

12. The cleaner of claim 11, wherein at least a part of the cyclone filter protrudes in a direction of the first dust storage part.

13. The cleaner of claim 1, wherein the cyclone part comprises a second cyclone disposed in the second dust storage part.

14. The cleaner of claim 13, wherein an axis of a cyclone flow in the second cyclone is provided in parallel with a horizontal plane corresponding to the ground.

15. The cleaner of claim 13, wherein the cyclone part further comprises a first cyclone disposed in the first dust storage part, and wherein the second cyclone is provided as a plurality of second cyclones disposed along an outer peripheral surface of the first cyclone.

16. The cleaner of claim 1, wherein the cyclone part further comprises a compression plate disposed in an opening portion of the first dust storage part.

17. A cleaner comprising:

a suction part elongated in one direction;

a dust bin including an inlet port connected to the suction part and provided at a first side thereof, a discharge port provided at a second side thereof, and a cyclone part configured to generate a cyclone flow; and a motor part that is disposed at an outside of the dust bin and connected to the discharge port of the dust bin and that is configured to generate a flow of air in the dust bin, wherein a longitudinal axis of the suction part intersects an axis of a cyclone flow in the cyclone part.

18. The cleaner of claim 17, wherein the inlet port is disposed in a radial direction of the longitudinal axis of the suction part and disposed in a radial direction of the axis of the cyclone flow.

19. The cleaner of claim 17, further comprising:

a handle disposed adjacent to the motor part, wherein the axis of the cyclone flow is perpendicular to a longitudinal axis of the handle.

* * * * *